US006795679B2

(12) United States Patent
Shimizu et al.

(10) Patent No.: US 6,795,679 B2
(45) Date of Patent: Sep. 21, 2004

(54) IMAGE HEATING APPARATUS AND HEAT GENERATING ROTARY MEMBER FOR USE IN THE SAME

(75) Inventors: Tadafumi Shimizu, Ogori (JP); Masahiro Samei, Fukuoka (JP); Kazunori Matsuo, Kasuga (JP); Shouichi Kitagawa, Fukuoka (JP); Keiichi Matsuzaki, Kurume (JP); Kenji Asakura, Kyoto (JP); Hideki Tatematsu, Ashiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/354,747

(22) Filed: Jan. 30, 2003

(65) Prior Publication Data

US 2003/0147679 A1 Aug. 7, 2003

(51) Int. Cl.[7] ..... G03G 15/20

(52) U.S. Cl. ..... 399/333; 219/216; 219/619; 399/328; 399/329

(58) Field of Search ..... 399/333, 330, 399/329, 328, 320; 219/619, 469, 216; 492/46, 53, 54; 118/60

(56) References Cited

U.S. PATENT DOCUMENTS

| | | | | |
|---|---|---|---|---|
| 5,768,673 A | | 6/1998 | Morigami | 399/330 |
| 5,801,359 A | | 9/1998 | Mano et al. | 219/667 |
| 6,449,457 B2 | | 9/2002 | Samei et al. | 399/328 |
| 6,605,802 B2 | * | 8/2003 | Nagahira | 219/619 |
| 6,654,585 B2 | * | 11/2003 | Hattori | 399/328 |
| 2002/0020699 A1 | | 2/2002 | Nagahira | 219/619 |
| 2002/0085867 A1 | | 7/2002 | Samei et al. | 399/329 |
| 2002/0141797 A1 | * | 10/2002 | Hirst et al. | 399/333 |

FOREIGN PATENT DOCUMENTS

| | | | |
|---|---|---|---|
| EP | 1 377 127 A1 | | 1/2004 |
| JP | 8-22206 | | 1/1996 |
| JP | 09-127810 | | 5/1997 |
| JP | 10-142985 | * | 5/1998 |
| JP | 11-030924 | * | 2/1999 |
| JP | 2001-242732 | | 9/2001 |
| JP | 2001-318546 | * | 11/2001 |
| JP | 2001-319764 | * | 11/2001 |
| JP | 2001-337551 | * | 12/2001 |
| JP | 2002-056961 | | 2/2002 |
| JP | 2002-280158 | * | 9/2002 |

* cited by examiner

*Primary Examiner*—Sophia S. Chen
(74) *Attorney, Agent, or Firm*—Pearne & Gordon LLP

(57) ABSTRACT

An image heating apparatus and heat generating rotary member for use in the image heating apparatus has a fixing roller including a magnetic metal layer and a non-magnetic metal layer, and the non-magnetic metal layer is provided on the outer side of the magnetic metal layer and is thinner than the magnetic metal layer.

20 Claims, 6 Drawing Sheets

IMAGE HEATING APPARATUS AND HEAT GENERATING ROTARY MEMBER FOR USE IN THE SAME

BACKGROUND OF THE INVENTION

1. Field of the Invention

The present invention relates to an image heating apparatus and a heat generating rotary member for use therein such as an image fixing device for use in an image forming apparatus of the electrostatic recording type, such as a copying machine, a facsimile machine, and a printer. More particularly, the invention relates to an image heating apparatus and a heat generating rotary member for use therein such as an image fixing device for fixing toner images, which uses the electromagnetic induction heating system.

2. Description of the Related Art

Recently, market demands for the energy saving and high operation speed are increasing in the image forming apparatus such as a copying machine, a facsimile machine, and a printer. To meet the demands, it is important to improve the thermal efficiency of the image fixing device used in the image forming apparatus.

In the image forming apparatus, an unfixed toner image is formed on a recording medium such as a recording sheet, a printing sheet, a photo sensitive sheet, or an electrostatic recording sheet, by an image transfer system or a direct system, and by an image forming process such as electrophotography recording process, electrostatic recording process or a magnetic recording process. An image fixing device based on such a contact heating system as a heat roller system, a film heating system, or an electromagnetic induction heating system is widely used for the image fixing device for fixing the unfixed toner image.

As for the image fixing device of the electromagnetic induction heating type, Japanese Unexamined Patent Publication No. H08-022206 discloses a technique which generates Joule heat is generated by an eddy current generated in a magnetic metal member by an alternating magnetic field applied thereto, and heats a heating bar including the metal member in an electromagnetic induction manner.

However, in this technique, it is a common practice to exclusively use a magnetic metal, such as ferritic stainless, iron, or Permalloy, for a heating part of the image fixing device. A nonmagnetic metal, such as aluminum, copper or titanium, has not been used for the heating part of the image fixing device. In this respect, there is still a need for improvement of the heating efficiency of the heating part.

SUMMARY OF THE INVENTION

To solve the problem stated above, the present invention presents the following solutions.

According to an aspect of the invention, there is provided a fixing roller for use in an image fixing device, wherein the fixing roller includes a magnetic metal layer and a non-magnetic metal layer, and the nonmagnetic metal layer is provided on the outer side of the magnetic metal layer, and is thinner than the magnetic metal layer.

Preferably, the fixing roller is a heating roller.

Furthermore, the fixing roller is a heating roller, and the non-magnetic metal layer contains copper.

Still further, the fixing roller is a heating roller, and the non-magnetic metal layer contains copper, and a thickness of the non-magnetic metal layer is within a range from 5 to 20 $\mu$m.

Furthermore, the image fixing the thickness of the magnetic metal layer is larger than 20 micrometers but equal to or smaller than 50 micrometers.

In the image fixing device using the thus constructed fixing roller, heat is more efficiently generated than in the image fixing device using a fixing roller formed with a single magnetic metal layer.

DETAILED DESCRIPTION OF THE PREFERRED EMBODIMENT (Image Forming Apparatus)

Figure 1:
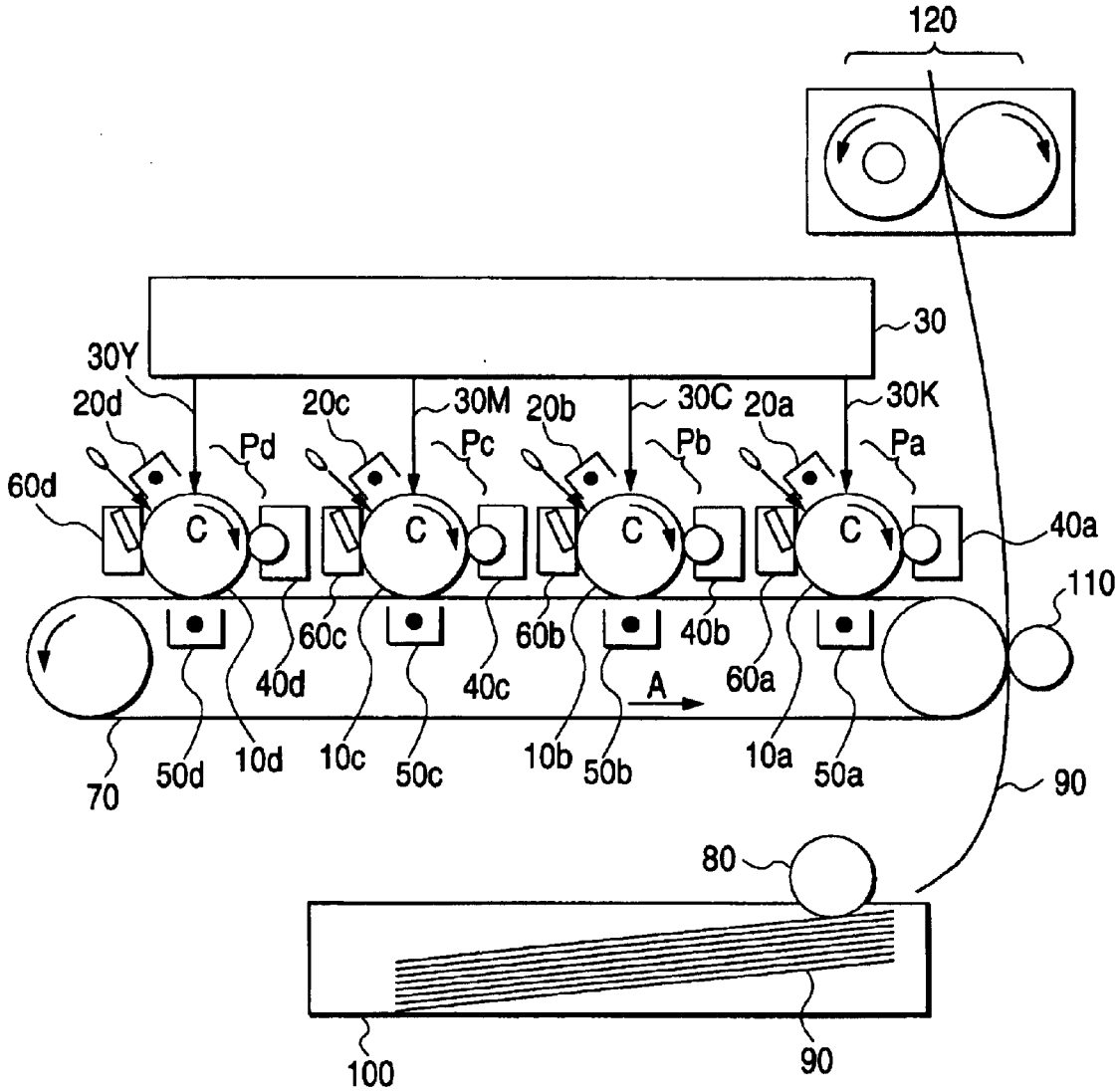
FIG. 1 is an explanatory diagram showing an image forming apparatus including an image fixing device which is an embodiment of the invention.

An outline of an image forming apparatus according to the present invention will first be described. FIG. 1 is an explanatory diagram showing an image forming apparatus including an image fixing device which is an embodiment of the invention. The image forming apparatus to be described is a xerography based image forming apparatus, inter alia, the image forming apparatus of the tandem type which includes developing units of toners of four fundamental colors which contributes to color development of a color image, and four color images are superimposed on a transfer member and collectively transferred onto a sheet of recording material. It will be readily understood that the invention may be applied not only to the tandem type image forming apparatus but also to any type of image forming apparatus, regardless of the number of developing units and presence of absence of the intermediate transfer body.

In FIG. 1, charging means 20*a* to 20*d*, exposure means 30, developing means 40*a* to 40*d*, transfer means 50*a* to 50*d*, and cleaning means 60*a* to 60*d* are disposed around photosensitive drums 10*a* to 10*d*, respectively. The charging means 20*a* to 20*d* uniformly charge surfaces of the photosensitive drums 10*a* to 10*d* to a predetermined potential, respectively. The exposure means 30 scans the surfaces of the charged photosensitive drums 10*a* to 10*d* by scan lines 30K, 30C, 30M and 30Y of laser beams corresponding to image data of specific colors, thereby forming electrostatic latent images thereon. The developing means 40*a* to 40*d* visualize the latent images formed on the photosensitive drums 10*a* to 10*d*, respectively. The transfer means 50*a* to 50*d* transfer the developed toner images respectively on the photosensitive drums 10*a* to 10*d* to an endless, intermediate transfer belt (intermediate transfer body) 70. The cleaning means 60*a* to 60*d* remove toner left on the photosensitive drums 10*a* to 10*d* after the toner images are transferred from the photosensitive drums 10*a* to 10*d* onto the intermediate transfer belt 70.

The exposure means 30 is disposed while being inclined, at a predetermined angle, to the photosensitive drums 10*a* to 10*d*. The intermediate transfer belt 70 is rotated in a direction of an arrow A as indicated in FIG. 1. Black, cyan, magenta and yellow images are formed at image forming stations Pa to Pd, respectively Monocolor images formed on the photosensitive drums 10*a* to 10*d* are successively and superimposedly transferred onto the intermediate transfer belt 70 to thereby form a full color image thereon.

A sheet feeding cassette 100 containing sheet materials 90, such as printing sheets, is provided under the image forming apparatus. Sheet materials 90 are fed one by one from the sheet feeding cassette 100 by means of a sheet feeding roller 80.

A sheet-material transfer roller 110 and an image fixing device 120 are arranged along a sheet transport path. The sheet-material transfer roller 110 is brought into contact with an outer peripheral surface of the intermediate transfer belt 70 over a predetermined amount of area, and transfers a color image that is formed on the intermediate transfer belt 70 onto the sheet material transfer roller 110 The image fixing device 120 fuses and fixes the color image having been transferred onto the sheet materials 90 by pressure and heat, which are caused through the nip and rotation of the roller.

In the thus constructed image forming apparatus, at the image forming station Pa, a latent image of a black component of image information is formed on the photosensitive drum 10*a* by means of the charging means 20*a* and the exposure means 30. The latent image is visualized into a black toner image by the developing means 40*a* containing black toner, and the black toner image is transferred onto the intermediate transfer belt 70 by the transfer means 50*a*.

During a transfer period that the black toner image is transferred onto the intermediate transfer belt 70, a latent image of a cyan component is formed at the image forming station Pb. Subsequently, the developing means 40*b* develops the latent image into a cyan toner image by using cyan toner. Then, the transfer means 50*b* at the image forming station Pb transfers the cyan toner image onto the intermediate transfer belt 70 to which the black toner image has been transferred at the image forming station Pa, whereby the cyan toner image is superimposed on the black toner image.

A magenta toner image and a yellow toner image are also formed in similar manners. When the superimposing process of the toner images of four colors is completed, the four color toner images are collectively transferred onto the sheet material 90 which has been fed from the sheet feeding cassette 100 by means of the sheet feeding roller 80. The superimposed toner image is heated and fixed on the sheet material 90 by the image fixing device 120, whereby a full color image is formed on the sheet material 90.

(Image Fixing Device)

An image fixing device for use in an image forming apparatus according to the invention will be described with reference to the accompanying drawings.

Figure 2:
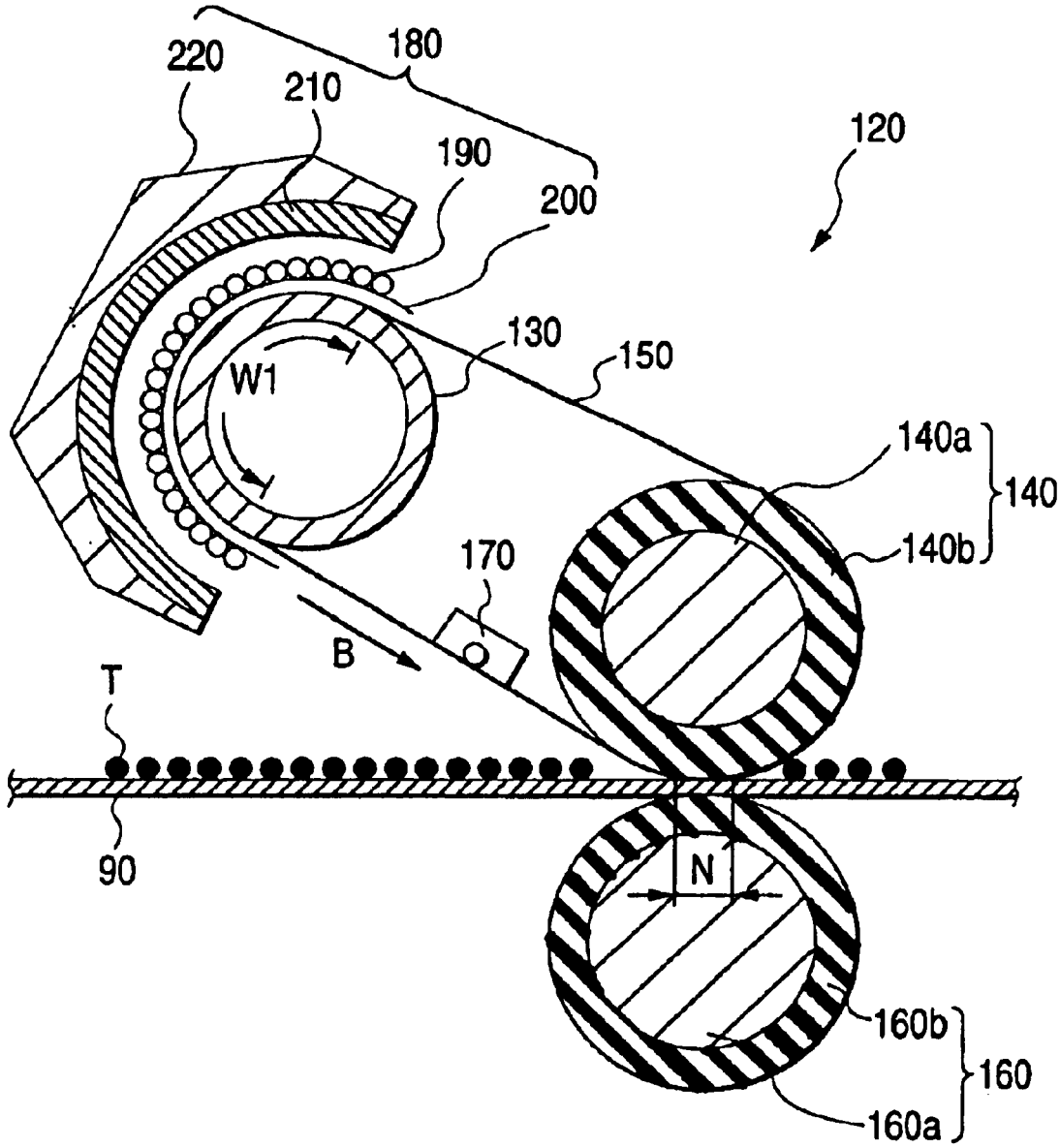
FIG. 2 is an explanatory diagram showing a mechanical arrangement of the image fixing device for use in an image forming apparatus according to an embodiment of the invention.

FIG. 2 is an explanatory diagram showing a mechanical arrangement of the image fixing device for use in an image forming apparatus according to an embodiment of the invention.

The image fixing device 120 shown in FIG. 2 includes a heating roller 130 heated through electromagnetic induction by an induction heating section 180, a fixing roller 140 disposed parallel to the heating roller 130, an endless, heat resistance belt (toner heating medium) 150 which is stretched between the heating roller 130 and the fixing roller 140, heated by the heating roller 130, and rotated in a direction of an arrow B with rotation of the heating roller 130 or the fixing roller 140, and a pressure roller 160 which is pressed against the fixing roller 140 with the heat resistance belt 150 being interposed therebetween, and rotates in the forward direction with respect to the heat resistance belt 150.

The heating roller 130 is formed with a hollowed, cylindrical magnetic metal member made of, for example, iron, cobalt or nickel or an alloy of those metallic materials. An outside diameter of the heating roller 130 is 20 mm, and a thickness thereof is 0.3 mm, a heat capacity thereof is low, and a temperature rising rate thereof is high.

The fixing roller 140 includes a core 140*a* made of a metallic material, e.g., stainless steel, and an elastic member 140*b*; covering the core 140*a*, formed with silicone rubber which has a heat resistance property or is in the form of solid state or in a foam. An outside diameter of the fixing roller 140 is about 30 mm, larger than that of the heating roller 130 in order to form a contact part of a predetermined width between the pressure roller 160 and the fixing roller 140 under a pressing force exerted from the pressure roller 160. The elastic member 140*b* is designed such that a thickness thereof is approximately 3 to 8 mm, and a harness thereof is about 15° to 50° in Asker hardness (6 to 25 in JIS-A hardness) By so selected, a heat capacity of the heating roller 130 is smaller than that of the fixing roller 140. Accordingly, the heating roller 130 is rapidly heated, thereby resulting in reduction of the warm-up time.

The heat resistance belt 150, which is stretched between the heating roller 130 and the fixing roller 140, is heated at the contact part W1 where it brought into contact with the heating roller 130 heated by the induction heating section 180. And, through the rotation of the heating roller 130 and the fixing roller 140, the inner surface of the heat resistance belt 150 is continuously heated, so that its entire surface is heated.

The image fixing device 120 and the heat resistance belt 150 will be described hereunder.

Figure 3:
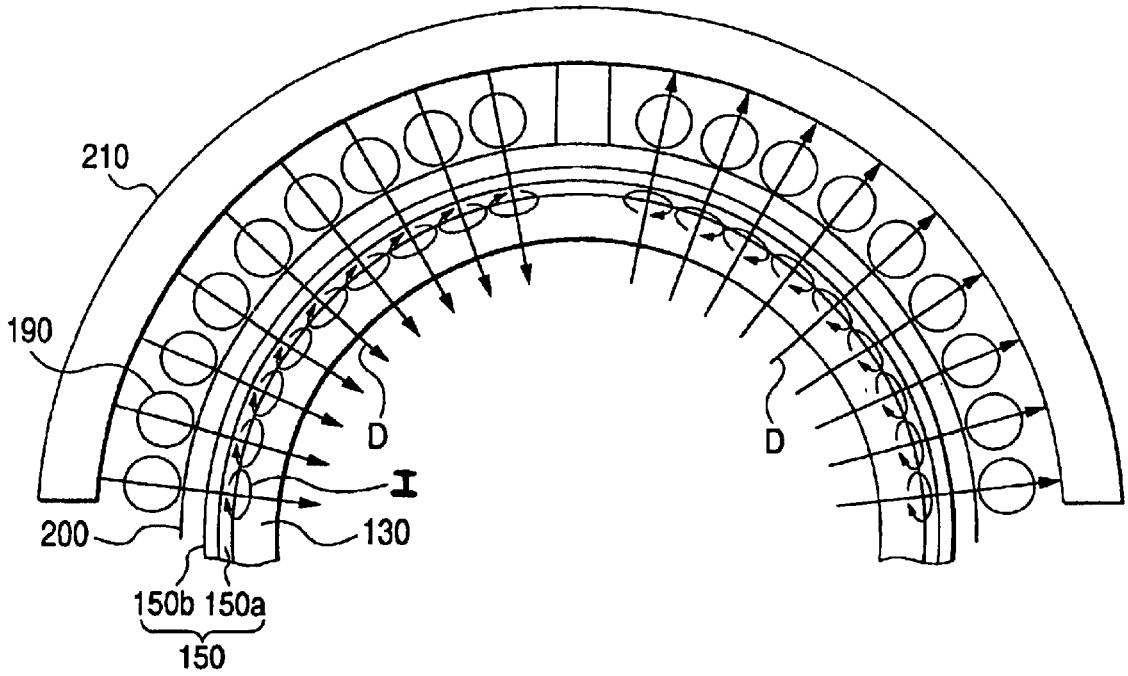
FIG. 3 is an explanatory diagram showing a heat resistance belt used for the image fixing device for use in the image forming apparatus according to the embodiment of the invention.

As shown in FIG. 3, the heat resistance belt 150 is a composite layer belt formed with a heating layer 150*a* and a release layer 150*b*. The heating layer contains a substrate which is made of a magnetic metal, e.g., iron, cobalt or nickel, or an alloy of them as base materials. The release layer is made of an elastic material, e.g., silicone rubber, or fluororubber, while covering a surface of the heat resistance belt.

Use of such a composite belt brings about the following advantages: the belt can directly be heated; the heating efficiency is increased, and the response speed is high.

If by some cause, a foreign material enters, for example, between the heat resistance belt 150 and the heating roller 130 to form a gap therebetween, the temperature distribution suffers from little irregularity since the heat resistance belt 150 per se generates heat by the electromagnetic induction of the heating layer 150*a* of the heat resistance belt 150. Accordingly, a high fixing reliability is ensured.

A thickness of the heating layer 150*a* is preferably within a range from about 20 μm to about 50 μm, more preferably about 30 μm.

As described above, the heating layer 150*a* is made of a magnetic metal, e.g., iron, cobalt or nickel, or an alloy of them as base materials. When a thickness of the heating layer is thicker than 50 μm, a distortion stress generated at the time of belt rotation is great. As a result, it is easily cracked by shearing force, and its mechanical strength is extremely reduced. When the thickness of the heating layer 150*a* is thinner than 20 μm or thinner, the composite layer belt is possibly cracked or broken by a thrust load, which is generated at the belt ends by a zig-zag motion of the rotating belt.

A thickness of the release layer 150*b* is preferably within a range from about 100 μm to 300 μm, more preferably about 200 μm. By so selected, a surface part of the heat resistance belt 150 satisfactorily covers a toner image T formed on the sheet material 90, so that the toner image T is uniformly heated and fused.

When the thickness of the release layer 150*b* is thinner than 100 μm, the heat capacitance of the heat resistance belt 150 is small. A belt surface temperature rapidly drops in the toner fixing process. An insufficient fixing performance is secured. When the thickness of the release layer 150*b* is thicker than 300 μm or thicker, the heat capacitance of the heat resistance belt 150 is large, and the warm up time is long. Additionally, the belt surface temperature is hard to drop in the toner fixing process, so that the cohesion effect of fused toner particles at the exit of the fixing stage cannot be obtained. A called hot offset phenomenon in which the releasability of the belt degrades and toner particles attach to the belt, occurs.

An inner surface of the heating layer 150*a* may be coated with resin in order to prevent metal oxidation and to secure its good contact with the heating roller 130.

The heating layer 150*a* formed with the metallic material mentioned above, which is used as the substrate of the heat resistance belt 150 may be substituted by a layer made of a resin having a heat resistance property, such as a fluororesin, polyimide resin, polyamide resin, polyamide-imide resin, PEEK resin, PES resin, and PPS resin.

In a case where the substrate is formed with a resin layer made of a resin having a high heat resistance property, the heat resistance belt 150 is easy to be in close contact with the heating roller 130 depending on a curvature of the heating roller. Heat contained in the heating roller 130 is efficiently transferred to the heat resistance belt 150. An additional advantage that the resin is used for the substrate of the heat resistance belt is that the belt is hard to be cracked. Use of the metal layer will provide a higher thermal conduction.

In this case, a thickness of the resin layer is preferably within a range of about 20 μm to about 150 μ, more preferably 75 μm. When the thickness of the resin layer is thinner than 20 μm, the resultant heat resistance belt cannot exhibit a satisfactory mechanical strength against the zig-zag motion of the rotating belt. When the thickness of the resin layer is thicker than 150 μm, a thermal conductivity of the resin layer is small. Accordingly, a heat transmission efficiency when heat is transmitted from the heating roller 130 to the release layer 150*b* of the heat resistance belt 150 is reduced, and the fixing performance is degraded.

In FIG. 2, the pressure roller 160 is constructed with a core 160*a* and an elastic member 160*b* provided on a surface of the core 160*a*. The core 160*a* is a cylindrical member made of a metallic material having a high thermal conduction, e.g., copper or aluminum. The elastic member 160*b* is good in heat resistance and toner releasability. SUS may be used for the core 160*a*, in place of the above metallic materials.

The pressure roller 160 presses the fixing roller 140 through the heat resistance belt 150 to thereby form a fixing nip part N. In the embodiment, a hardness of the pressure roller 160 is harder than that of the fixing roller 140, whereby the pressure roller 160 is dug into the fixing roller 140 (and the heat resistance belt 150). By this, the sheet material 90 follows a circumferential shape of a surface of the pressure roller 160. Accordingly, the sheet material 90 is easy to separate from the surface of the heat resistance belt 150. An outside diameter of the pressure roller 160 is about 30 mm, equal to that of the fixing roller 140, but a thickness of the elastic member is about 2 to 5 mm, thinner than the elastic member 140*a* of the fixing roller 140. A hardness of the pressure roller is 20° to 60° in Asker hardness (6 to 25° in JIS-A hardness), and harder than that of the fixing roller 140 as already referred to.

A construction of the induction heating section 180 will be described. The induction heating section 180 for heating the heating roller 130 by use of the electromagnetic induction includes an exciting coil 190 as a magnetic field generating means and a coil guide plate 200 with the exciting coil 190 wound therearound. The coil guide plate 200, semicylindrical in shape, is disposed close to an outer peripheral surface of the heating roller 130. The exciting coil 190 is formed by alternately winding a long exciting coil member on and along the coil guide plate 200 in the axial direction of the heating roller 130. A length of the part over which the coil is wound is equal to a length of a region where the heat resistance belt 150 is in contact with the heating roller 130.

With such a construction, an area of the heating roller 130 to be induction heated by the induction heating section 180 is maximized, and a time that the surface of the heating roller 130 being heated is in contact with the heat resistance belt 150 is also maximized. Accordingly, an efficiency of transmitting heat from the heating roller to the heat resistance belt 150 is increased.

The exciting coil 190 is connected to a drive power source (not shown) containing an oscillation circuit whose oscillating frequency is variable.

A exciting coil core 210 which is semicylindrical in shape and formed with a ferromagnetic body made of ferrite, for example, is disposed outside the exciting coil 190 in a state that the exciting coil core is fixed to an exciting coil core support member 220 and is disposed close to the exciting coil 190. In the embodiment, a relative permeability of the exciting coil core 210 is 2500.

As shown in FIG. 3, a high frequency AC current at 10 kHz to 1 MHz, preferably 20 kHz to 800 kHz, is fed to the exciting coil 190 from the drive power source, thereby generating an alternating magnetic field. The alternating magnetic field acts on the heating roller 130 and the heating layer 150*a* of the heat resistance belt 150 at a contact area W1 between the heating roller 130 and the heat resistance belt 150 and its vicinity. In the interior of them, eddy current I flows in a direction in which a variation of the alternating magnetic field D is impeded.

This eddy current I causes Joule heat whose amount depends on resistance values of the heating roller 130 and the heating layer 150*a*. The heating roller 130 and the heat resistance belt 150 having the heating layer 150*a* are induction heated at the contact area W1 between the heating roller 130 and the heat resistance belt 150 and its vicinity.

At a position near the entrance of the nip part N shown in FIG. 2, a temperature of the inner surface of the heat resistance belt 150 thus heated is detected by temperature detecting means 170 disposed in contact with the inner surface of the heat resistance belt 150. The temperature detecting means 170 may be a thermosensitive element of good thermal response, such as a thermistor.

Therefore, there is no chance that the temperature detecting means 170 damages the surface of the heat resistance belt 150. And the necessary fixing performance is continuously secured. Further, a temperature at a position just before it enters the nip part N of the heat resistance belt 150 is detected Electric power input to the induction heating section 180 is controlled in accordance with a signal output based on the temperature information, whereby a temperature of the heat resistance belt 150 is stably kept at 180° C., for example.

In the embodiment, the fixing nip part N is formed by the heat resistance belt 150, which is heated by the heating roller 130 heated by the induction heating section 180, and the pressure roller 160 When a toner image T, which is formed on the sheet material 90 in an image forming section (not shown), is introduced into the nip part N, the heat resistance belt 150 is fed to the nip part N in state that a temperature difference between the front and rear surfaces of the belt is small. A called overshoot in which a belt surface temperature is excessively high with respect to a set temperature is suppressed, and a temperature control of the heat resistance belt 150 as a toner heating medium is stably performed.

Accordingly, in a fixing process, the heat resistance belt 150 being maintained at a fixed temperature comes in contact with the toner image T, whereby a stable fixing quality is secured.

Another image fixing device to be used in an image forming apparatus constructed according to the invention will be described. In the image fixing device, the toner image is directly fixed by use of the heating roller 130, not using the heat resistance belt 150.

Figure 4:
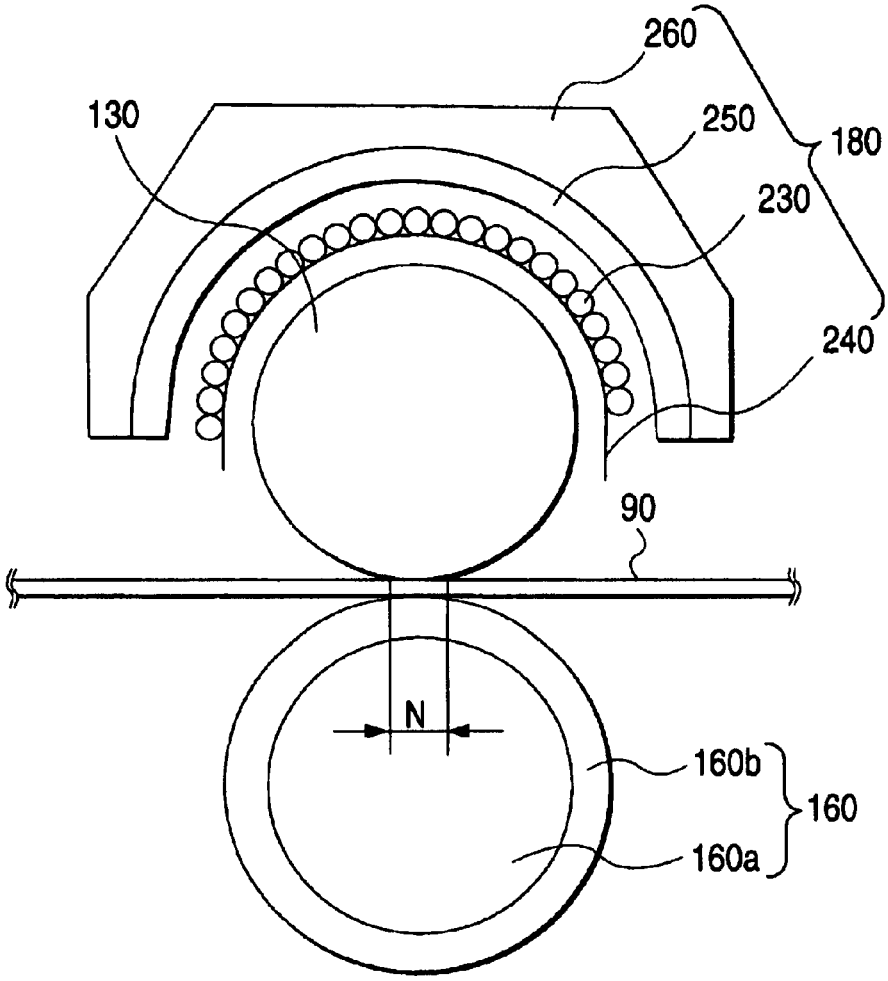
FIG. 4 is an explanatory diagram showing a mechanical arrangement of another image fixing device for use in an image forming apparatus according to an embodiment of the invention.

FIG. 4 is an explanatory diagram showing a mechanical arrangement of another image fixing device for use in an image forming apparatus according to an embodiment of the invention.

The image fixing device shown in FIG. 4 includes a heating roller 130 to be induction heated by the induction heating section 180, and a pressure roller 160 which is pressed against the heating roller 130 and rotates in a forward direction with respect to the heating roller 130.

The heating roller 130 is formed with a hollowed, cylindrical magnetic metal member made of, for example, iron, cobalt or nickel or an alloy of those metallic materials. An outside diameter of the heating roller is 20 mm, and a thickness of it is 0.3 mm, a heat capacity of it is low, and a temperature rising rate of it is high.

An outside diameter of the heating roller 130 is selected to be about 30 mm in order to form a contact part of a predetermined width between the pressure roller 160 and the heating roller 130.

A release layer made of polyimide may be formed on an outermost layer of the heating roller 130. In this case, a thickness of the release layer is preferably within a range from about 100 μm to 300 μm, more preferably about 200 μm. By so selected, a surface part of the heating roller 130 satisfactorily covers a toner image T formed on the sheet material 90, so that the toner image T is uniformly heated and fused.

When the thickness of the release layer is thinner than 100 μm, the heat capacitance of the heating roller 130 is small. A belt surface temperature rapidly drops in the toner fixing process. An insufficient fixing performance is secured. When the thickness of the release layer is thicker than 300 μm, the heat capacitance of the heating roller 130 is large, and the warm up time is long. Additionally, the belt surface temperature is hard to drop in the toner fixing process, so that the cohesion effect of fused toner particles at the exit of the fixing stage cannot be obtained. A called heat offset phenomenon in which the releasability of the heating roller 130 degrades and toner particles attach to the heating roller 130, occurs.

A construction of the induction heating section 180 will be described. The induction heating section 180 for heating the heating roller 130 by the electromagnetic induction includes an exciting coil 230 as a magnetic field generating means and a coil guide plate 240 with the exciting coil 230 wound therearound. The coil guide plate 240, semicylindrical in shape, is disposed close to an outer peripheral surface of the heating roller 130. The exciting coil 230 is formed by alternately winding a long exciting coil member on and along the coil guide plate 240 in the axial direction of the heating roller 130.

With such a construction, an area of the heating roller 130 to be induction heated by the induction heating section 180 is maximized, and a heat generating efficiency is increased.

The exciting coil 230 is connected to a drive power source (not shown) containing an oscillation circuit whose oscillating frequency is variable.

An exciting coil core 250 which is semicylindrical in shape and formed with a ferromagnetic body made of ferrite, for example, is disposed outside the exciting coil 230 in a state that the exciting coil core is fixed to an exciting coil core support member 260 and is disposed close to the exciting coil 230. Also in the embodiment, a relative permeability of the exciting coil core 230 is 2500.

The pressure roller 160 is constructed with a fixing roller 160*a* and an elastic member 160*b* provided on a surface of the fixing roller 160*a*. The fixing roller 160*a* is a cylindrical member made of a metallic material having a high thermal conduction, e.g., copper or aluminum. The elastic member 160*b* is good in heat resistance and toner releasability. SUS may be used for the core 160*a*, in place of the metallic material.

The pressure roller 160 presses the heating roller 130 to thereby form a fixing nip part N. In the embodiment, a hardness of the pressure roller 160 is harder than that of the heating roller 130, whereby the pressure roller 160 is dug into the heating roller 130. By this, the sheet material 90 follows a circumferential shape of a surface of the heating roller 130. Accordingly, the sheet material 90 is easy to separate from the surface of the heating roller 130. An outside diameter of the heating roller 130 is about 30 mm, and a thickness of it is about 25 mm, a hardness of it is relatively high, i.e., 20° to 60° in Asker hardness (6° to 25° in JIS-A hardness)

(Heating Roller Construction)

The heating roller 130 having a nonmagnetic layer will be described A construction of the heating roller 130 to be described hereunder may be applied not only to the heating roller 130 as described with reference to FIG. 2, but also the heating roller 130 as described with reference to FIG. 4.

In designing the image fixing device of the image forming apparatus which is based on the electromagnetic induction heating method, the heating part of the heating roller 130, generally, is formed with a hollowed, cylindrical magnetic metal member made of, for example, iron, cobalt or nickel or an alloy of those metallic materials. 430 stainless steel as typical ferrite stainless steel exhibits high skin electrical resistance value of $23.3\times10^{-4}\Omega$ when a high frequency current of 25 KHz is fed to the exciting coil 190, and a skin electrical resistance value of iron is high, $9.4\times10^{-4}\Omega$. Accordingly, the material is fit for the electromagnetic induction heating.

A skin electrical resistance value of aluminum is low, $0.48\times10^{-4}\Omega$, and that of copper is $3.9\times10^{-4}\Omega$. Accordingly, normally, those materials are not fit for the electromagnetic induction heating. Accordingly, when a magnetic field is applied to a non-magnetic metal, a counter magnetic field is developed in the non-magnetic metal and hence a counter current flows therein. The magnetic field cannot pass through the non-magnetic metal. Therefore, it is impossible to generate heat in the non-magnetic metal layer by the electromagnetic induction heating.

As a thickness of the non-magnetic metal layer is progressively decreased, its skin electrical resistance value increases. Accordingly, the counter magnetic field is hard to be generated, and hence, the magnetic field is easy to pass through the non-magnetic metal, and eddy current is generated in the stainless steel. As a consequence, the non-magnetic metal layer and the magnetic metal layer made of, for example, stainless steel are both heated, thereby enabling the electromagnetic induction heating.

Where the heating part of the heating roller is thus formed with a combination of the non-magnetic metal layer and the magnetic metal layer of stainless steel, even if the non-magnetic metal layer is provided on the outer surface of the heating roller 130, the heating roller 130 more efficiently generates heat than the heating roller formed simply with a single magnetic metal layer.

Figure 5:
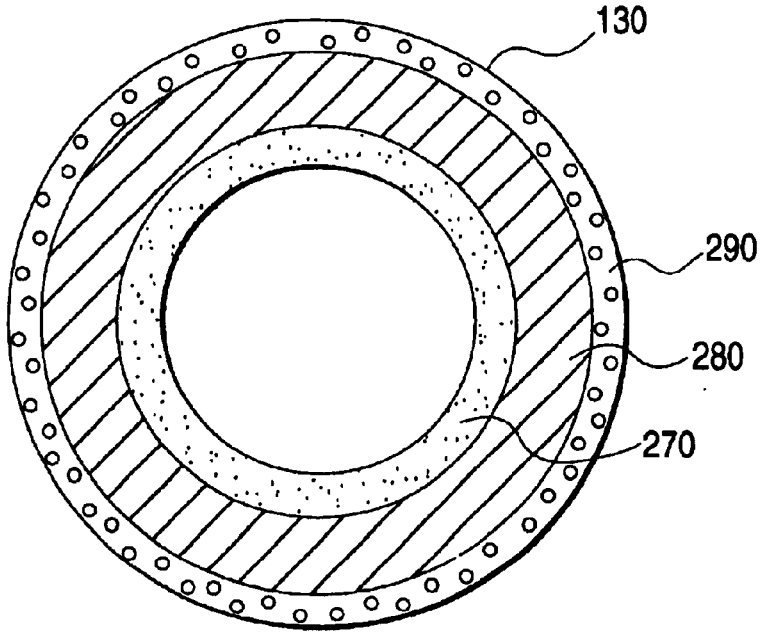
FIG. 5 is an explanatory diagram showing a heating roller used for the image fixing device for use in the image forming apparatus) according to the embodiment of the invention.

The heating roller 130 using the non-magnetic metal layer will he described in detail. FIG. 5 is an explanatory diagram showing a heating roller used for an image fixing device for use in an image forming apparatus according to an embodiment of the invention. The heating roller 130 is formed with an aluminum layer 270 of 1 mm thick, a ferrite stainless steel layer 280 of 0.4 mm to 0.8 mm thick, and a copper layer 290 of 5 $\mu$m thick. The ferrite stainless steel layer 280 as a magnetic metal layer and the copper layer 290 as a non-magnetic metal layer form a heat generating layer to be induction heated.

Use of the aluminum layer 270 of 1 mm thick provides a good thermal conduction in a longitudinal direction of the roller, and lessens an irregular temperature distribution over the roller, which will appear in the case of the sheet of a small size.

The ferrite stainless steel is used for a material of the magnetic metal layer in the embodiment. It is evident that the material is not limited to such, and may be any material which permits the electromagnetic induction. To obtain the effects intended by the invention, the aluminum layer 270 is not essential to the heating layer, but the heating layer may be formed with at least the ferrite stainless steel layer 280 of the magnetic metal and the copper layer 290 of the non-magnetic metal.

When an AC current of high frequency of, for example, 25 kHz is fed to the exciting coil 190 associated with the thus constructed heating roller 130, magnetic field lines are developed from the exciting coil 190. The magnetic field lines enter the copper layer 290 and the ferrite stainless steel layer 280, which form an induction heating part of the heating roller 130, and eddy current is generated therein and heat is generated in the heating roller 130. While in the instant embodiment, the frequency of the high frequency current is 25 kHz, the frequency may be varied as the situation demands, and a thickness of the non-magnetic metal layer may also be varied, if required.

Figure 6:
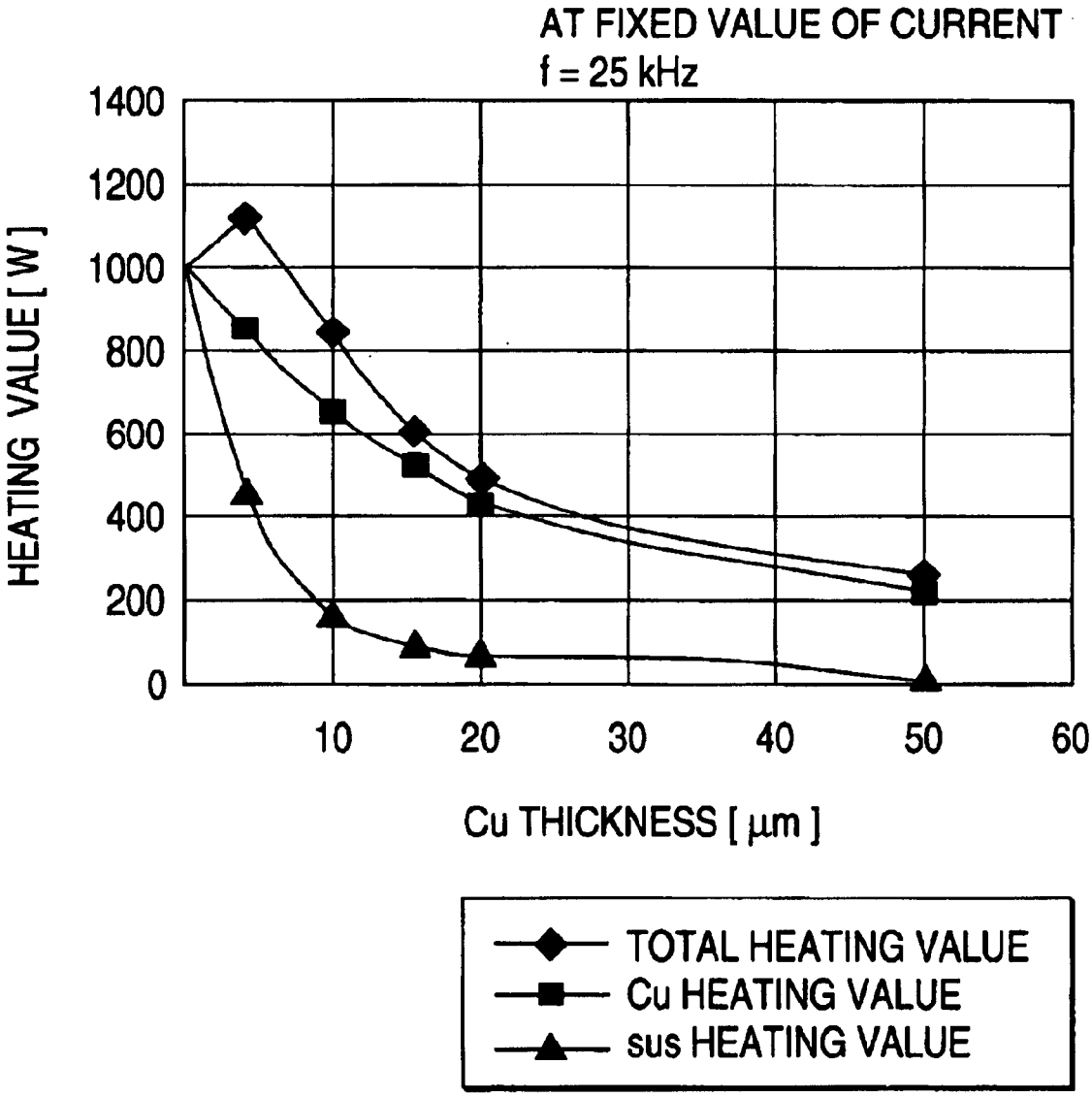
FIG. 6 is a graph showing characteristic curves representative of heating value transient variations with respect to a copper layer thickness.

A method of determine a thickness of the non-magnetic metal layer will be described. FIG. 6 is a graph showing characteristic curves representative of heating value transient variations with respect to a copper layer thickness. As shown in FIG. 6, when a thickness of the non-magnetic metal layer of the electromagnetic induction heat generating part is selected to be 0.1 to 2.0 times as large as its thickness at which it has a skin electric resistance value equal to that of the iron layer, the heating generation is more remarkable.

A thickness "t" of the non-magnetic metal layer at which it has a skin electric resistance value equal to that of the iron layer is derived by using the following calculation formula.

$$t=\delta \text{ of non-magnetic metal}\times Rs \text{ of non-magnetic metal}/Rs \text{ of iron}$$

In the above formula, δ is a skin depth, and Rs is a skin electric resistance value. δ and Rs can be expressed by the following formulae.

$$\delta=5.03\times10^{3}\times(\rho/\mu/f)^{1/2}$$

$$Rs=\rho/\epsilon=1.99\times10^{-4}\times(\mu\times\rho\times f)^{1/2}$$

where ρ is a specific resistance value of a material, $\mu$ is a magnetic permeability, and f is a frequency.

As described above, a skin resistance value of iron is $9.4\times10^{-4}\Omega$ at 25 kHz. When the image forming apparatus is operated by, for example, a high frequency current at 25 kHz and the above formula is applied to an aluminum layer, t=28 $\mu$m. In the case of copper layer, t=18 $\mu$m, and in the case of a titanium layer, t=586 $\mu$m. The graph shows that in those thickness regions, those materials have electromagnetic induction heating characteristics as iron. A thickness of the non-magnetic metal layer necessary for obtaining a skin resistance value equal to that of iron is calculated while taking a frequency band used into consideration. A non-magnetic metal layer having a thickness 0.1 to 2 times as large as that thickness is located on an outer surface of a magnetic metal layer, whereby efficient heat generation is secured.

Next, an optimum thickness of the copper layer 290 is considered. An image fixing device as described in the embodiment of the invention and a typical conventional image fixing device of the electromagnetic induction heating type, which uses a clad material formed with an aluminum layer 270 of 1 mm thick and a ferrite stainless steel layer 280 of 0.8 mm thick, were used for comparison. Heating values in those image fixing device, which are caused by 25 kHz eddy current were compared. Other constructions than the image fixing device are equal to each other. An electric wire capable of generating a heating value of 1000W was applied to the comparison system in which the heating layer consists of the ferrite stainless steel layer 280. In the comparison system, when a copper layer of 5 $\mu$m thick as a non-magnetic metal layer is applied on the outer surface of the stainless layer, heat of about 1100 W was generated, and its value was increased by about 10%.

A total of heating values is obtained by adding together the heating values of copper and ferrite stainless layers. As shown in FIG. 6, the total of heating values varies as a thickness of a copper layer as a non-magnetic layer increases. In the present conditions, a local maximum of the total heating value appears at a thickness value of about 5 $\mu$m. A heating value of the image fixing device of the invention was higher than that of the image fixing device using only the ferrite stainless layer.

The results of the experiment showed that when the copper layer of 5 μm thick was used, heat was most efficiently generated. A thickness of the nonmagnetic metal layer which produces a maximum heating value varies depending on a kind of non-magnetic metal, a frequency used, inductance of the exciting coil and other electrical characteristics. In this respect, it is necessary to select the thickness of the non-magnetic metal layer in accordance with situations. When considering various conditions, the thickness of the copper layer is selected to be most preferably within a range of 5 to 20 μm.

(Heat Resistance Belt Construction)

Figure 7:
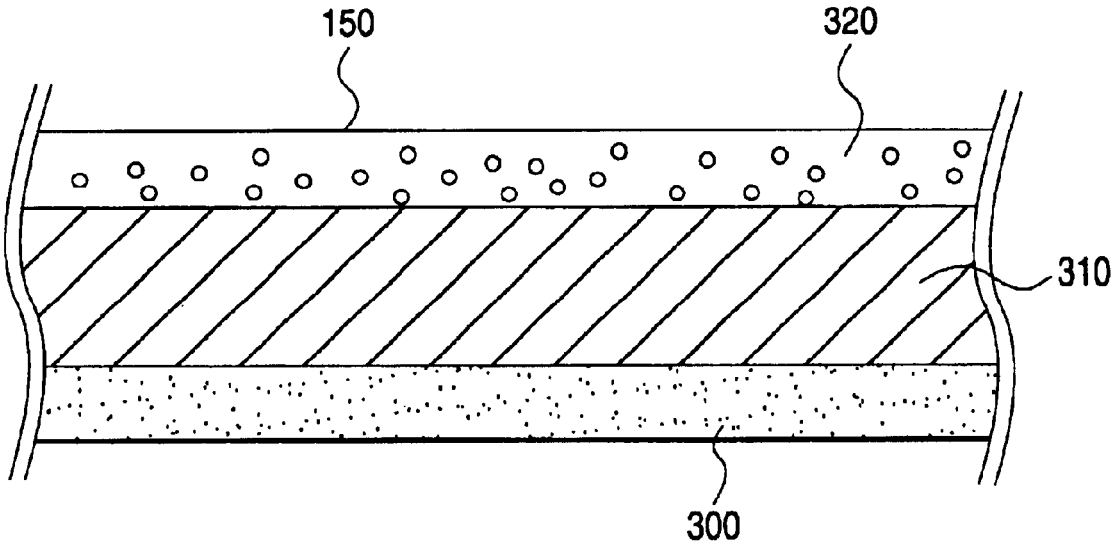
FIG. 7 is a diagram showing the details of a heat resistance belt used for the image fixing device for use in the image forming apparatus according to the embodiment of the invention.

While a non-magnetic layer is used for the heating roller 130 in the description given above, the non-magnetic layer may be used for the heat resistance belt 150. Such a case will be described hereunder. FIG. 7 is a diagram showing the details of a heat resistance belt used for an image fixing device for use in an image forming apparatus according to the embodiment of the invention. A heat resistance belt 150 is formed with a clad material including an aluminum layer 300, a ferrite stainless steel layer 310 of 40 μm thick and a copper layer 320 of 5 μm thick. The ferrite stainless steel layer 310 as a magnetic metal layer and the copper layer 320 as a non-magnetic metal layer form a heating layer based on the electromagnetic induction. The ferrite stainless steel layer 310 may be replaced with a nickel layer.

The ferrite stainless steel is used for a material of the magnetic metal layer in the embodiment. It is evident that the material is not limited to such, and may be any material which permits the electromagnetic induction. To obtain the effects intended by the invention, the heating layer may be formed with at least the ferrite stainless steel layer 310 of the magnetic metal and the copper layer 320 of the non-magnetic metal.

When an AC current of high frequency of, for example, 25 kHz is fed to the exciting coil 190 associated with the thus constructed heat resistance belt 150, magnetic field lines are developed from the exciting coil 190. The magnetic field lines enter the copper layer 320 and the ferrite stainless steel layer 310, which form an induction heating part of the heat resistance belt 150, and eddy current is generated therein and heat is generated in the heat resistance belt 150. While in the instant embodiment, the frequency of the high frequency current is 25 kHz, the frequency may be varied as the situation demands, and a thickness of the non-magnetic metal layer may also be varied, if required. As taught by the experiment results, it is most preferable that the thickness of the non-magnetic metal layer is selected to be within a range from 5 to 20 μm.

In the embodiment shown in FIG. 7, the heat resistance belt 150 is formed with the magnetic metal layer and the non-magnetic metal layer. In a modification, a magnetic metal layer is used for the heating roller 130 in FIG. 2, and a non-magnetic metal layer, which is thinner than that of the magnetic metal layer of the heating roller 130, is used for the heat resistance belt 150.

As seen from the foregoing description, in the invention, a non-magnetic metal layer made of a non-magnetic metal of low resistance, such as metal, silver or copper, and a magnetic metal layer made of a metallic material, e.g., stainless steel, are combined and the combined layers are used for the heating roller, the fixing belt and the like. The heating roller, for example, using the combined layers more efficiently generates heat than the heating roller formed simply with a single magnetic metal layer.

Further, as described above, the thin-film like non-magnetic metal layer is located on the outer side of the magnetic metal layer, and is thinner than the latter, and the coil is disposed closer to the thin-film like non-magnetic metal layer. With the feature, heat generating efficiency is improved. From various experiments, it is confirmed that when a thickness of the thin-film like non-magnetic metal layer is selected to be within a range from 5 μm to 20 μm, the heat generating efficiency is most improved.

What is claimed is:

1. An image fixing device comprising:

a fixing roller including a magnetic metal layer and a non-magnetic metal layer, wherein the non-magnetic metal layer is provided on an outer side of said magnetic metal layer and is thinner than said magnetic metal layer; and a coil disposed at a side where the non-magnetic metal layer is provided.

2. The image fixing device according to claim 1, wherein said fixing roller is a heating roller.

3. The image fixing device according to claim 1, wherein said fixing roller is a heating roller, and said non-magnetic metal layer contains copper.

4. The image fixing device according to claim 1, wherein said fixing roller is a heating roller, and said non-magnetic metal layer contains copper, and a thickness of said non-magnetic metal layer is within a range from 5 to 20 micrometers.

5. The image fixing device according to claim 1, wherein said fixing roller is a heating roller and a thickness of said non-magnetic metal layer is within a range from 5 to 20 micrometers.

6. A heat generating rotary member for use in an image heating apparatus of an electromagnetic induction type comprising:

a magnetic metal layer; and a non-magnetic metal layer provided on an outer side of the magnetic metal layer, said non-magnetic metal layer having a thickness smaller than a thickness of the magnetic metal layer, wherein the non-magnetic metal layer has thickness within a range from 5 to 20 micrometers.

7. An image heating apparatus comprising:

a heating roller including a magnetic metal layer having a first thickness;

an exciting coil disposed to face said heating roller;

a belt suspended to be in contact with a part of said heating roller, part of said belt being positioned between said heating roller and said exciting coil; and said belt comprising a non-magnetic metal layer thinner than the first thickness.

8. The heat generating rotary member according to claim 7, wherein said non-magnetic metal layer includes copper.

9. The heat generating rotary member according to claim 7, wherein the thickness of the non-magnetic metal layer is within a range from 5 to 20 micrometers.

10. A heat generating rotary member for use in an image heating apparatus of an electromagnetic induction type, comprising:

a magnetic metal layer having a skin electric resistance; and a non-magnetic metal layer provided on an outer side of the magnetic metal layer, said non-magnetic metal layer having a thickness in a range of 0.1 to 2.0 times a thickness at which the non-magnetic metal has a skin electric resistance value equal to the skin electric resistance value of the magnetic metal layer.

11. An image fixing device of an electromagnetic induction type, comprising:

a pair of rollers; and a belt suspended to be in contact with said pair of rollers, said belt having a first layer including magnetic metal and a second layer provided on an outer side of said first layer, said first layer having a first thickness, said second layer having a second thickness smaller than said first thickness, said second layer including a non-magnetic metal.

12. The image fixing device according to claim 11, wherein said second layer includes copper.

13. The image fixing device according to claim 12, further comprising a coil located outside of one of said pair of rollers.

14. The image fixing device according to claim 11, wherein the second thickness is within a range from 5 to 20 micrometers.

15. The image fixing device according to claim 14, further comprising a coil located outside of one of said pair of rollers.

16. The image fixing device according to claim 11, wherein the thickness of the second layer is less than or equal to 20 micrometers.

17. An image fixing device comprising:

a heating roller including a first layer including a magnetic metal and a second layer including a non-magnetic metal, wherein the second layer is provided on an outer side of said first layer and is thinner than said first layer; and a coil disposed at a side where the second layer is provided.

18. The image fixing device according to claim 17, wherein the non-magnetic metal is copper.

19. The image fixing device according to claim 17, wherein a thickness of the second layer is within a range from 5 to 20 micrometers.

20. The image fixing device according to claim 17, wherein the non-magnetic metal is copper and a thickness of the second layer is within a range from 5 to 20 micrometers.

* * * * *

UNITED STATES PATENT AND TRADEMARK OFFICE

CERTIFICATE OF CORRECTION

PATENT NO. : 6,795,679 B2
DATED : September 21, 2004
INVENTOR(S) : Shimizu et al.

It is certified that error appears in the above-identified patent and that said Letters Patent is hereby corrected as shown below:

Title page,
Please add:
-- [30] Foreign Application Priority Data
Jan. 30, 2002 (JP) ……. 2002-021478 --.

Signed and Sealed this

Seventh Day of June, 2005

JON W. DUDAS
*Director of the United States Patent and Trademark Office*